US008910604B2

(12) United States Patent
Adachi et al.

(10) Patent No.: US 8,910,604 B2
(45) Date of Patent: Dec. 16, 2014

(54) VALVE TIMING CONTROL DEVICE

(75) Inventors: Kazunari Adachi, Chiryu (JP); Yuji Noguchi, Obu (JP); Atsushi Homma, Kariya (JP); Takeo Asahi, Kariya (JP)

(73) Assignee: Aisin Seiki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 13/991,071

(22) PCT Filed: Jan. 23, 2012

(86) PCT No.: PCT/JP2012/051356

§ 371 (c)(1),
(2), (4) Date: May 31, 2013

(87) PCT Pub. No.: WO2012/111388

PCT Pub. Date: Aug. 23, 2012

(65) Prior Publication Data

US 2013/0247855 A1 Sep. 26, 2013

(30) Foreign Application Priority Data

Feb. 18, 2011 (JP) ..... 2011-033813

(51) Int. Cl.
*F01L 1/34* (2006.01)
*F01L 1/047* (2006.01)
*F01L 1/344* (2006.01)

(52) U.S. Cl.
CPC . *F01L 1/34* (2013.01); *F01L 1/047* (2013.01); *F01L 1/3442* (2013.01); *F01L 2001/0476* (2013.01); *F01L 2103/00* (2013.01)
USPC ..... 123/90.17

(58) Field of Classification Search
CPC ..... F01L 1/344; F01L 1/13442
USPC ..... 123/90.6; 29/888.1
See application file for complete search history.

(56) References Cited

U.S. PATENT DOCUMENTS 8,028,667 B2 * 10/2011 Hayashi ..... 123/90.17
2006/0137635 A1 6/2006 Hayashi (Continued)

FOREIGN PATENT DOCUMENTS

DE 101 63 792 A1 7/2003
DE 10 2004 019 190 A1 11/2005

(Continued)

OTHER PUBLICATIONS

International Search Report (PCT/ISA/210) issued on Apr. 24, 2012, by the Japanese Patent Office as the International Searching Authority for International Application No. PCT/JP2012/051356.

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve timing control device that enables simplification of the manufacturing process and reduction of the number of parts while suppressing deformation of a driven rotary element. The valve timing control device includes a driving rotary element, a driven rotary element, a plurality of partitions each for dividing a fluid pressure chamber into a regarded angle chamber and an advanced angle chamber, and a connecting element for connecting the driven rotary element to a camshaft. The connecting element includes a press fitting portion having a plurality of fitting segments configured to fit to an inner circumference of a recess of the driven rotary element. At least one of centerlines of the fitting segments extending in a radial direction does not overlap any of the partitions.

7 Claims, 6 Drawing Sheets

(56) References Cited

U.S. PATENT DOCUMENTS

| | | | | |
|---|---|---|---|---|
| 2006/0278187 | A1 | 12/2006 | Lichtenwald et al. | |
| 2010/0199937 | A1 | 8/2010 | Fujiyoshi | |
| 2011/0168112 | A1 | 7/2011 | Noguchi et al. | |
| 2012/0132160 | A1* | 5/2012 | Malen et al. | 123/90.15 |
| 2013/0213331 | A1* | 8/2013 | Landersdorfer et al. | 123/90.17 |

FOREIGN PATENT DOCUMENTS

| | | | |
|---|---|---|---|
| DE | 10 2008 011 116 | A1 | 8/2009 |
| EP | 1 881 168 | A1 | 1/2008 |
| JP | 2002-180809 | A | 6/2002 |
| JP | 2006-183590 | A | 7/2006 |
| JP | 2008-144590 | A | 6/2008 |
| JP | 2011-140929 | A | 7/2011 |

OTHER PUBLICATIONS

Written Opinion (PCT/ISA/237) issued on Apr. 24, 2012, by the Japanese Patent Office as the International Searching Authority for International Application No. PCT/JP2012/051356.

English language translation of International Preliminary Report on Patentability issued Aug. 21, 2013 by The International Bureau of WIPO in International Application No. PCT/JP2012/051356.

The extended European Search Report issued on Feb. 24, 2014, by the European Patent Office in corresponding European Patent Application No. 12747141.5-1603. (7 pages).

* cited by examiner

VALVE TIMING CONTROL DEVICE

TECHNICAL FIELD

The present invention relates to a valve timing control device including a driving rotary element synchronously rotatable with a crankshaft; a driven rotary element mounted coaxially with the driving rotary element and synchronously rotatable with a camshaft; and a plurality of partitions provided in the driven rotary element each for dividing a fluid pressure chamber formed between the driving rotary element and the driven rotary element into a regarded angle chamber and an advanced angle chamber.

BACKGROUND ART

When the driven rotary element is bolted to the camshaft, the fastening pressure applied to the driven rotary element is increased because of a small contacting area between the camshaft and the driven rotary element. In general, an aluminum material of low rigidity is often used for manufacturing the driven rotary element, and thus the driven rotary element is easily deformed.

Under the circumstances, a connecting element is disposed between the driven rotary element and the camshaft. This increases the contacting area between the camshaft and the driven rotary element to reduce a pressing force exerted upon the driven rotary element per unit area, as a result of which the deformation of the driven rotary element can be prevented.

Various parts are manufactured in various component facilities and delivered to an assembly shop to assemble the driven rotary element to the camshaft. The driven rotary element, the driving rotary element and the connecting element of all the components are manufactured in the same component facility and delivered as an assembled unit. The connecting element is press-fitted to a recess formed in one side of the driven rotary element and delivered as an integrated unit. Such an integrated configuration advantageously alleviates the trouble in delivery and facilitates the assembling work of the camshaft.

On the other hand, when the connecting element is press-fitted to the recess of the driven rotary element, only the surface of the driven rotary element provided with the recess is enlarged in diameter, as a result of which the entire driven rotary element may disadvantageously be deformed outward of the surface in a direction opposite to the recess. As a measure for overcoming such a disadvantage, Japanese Unexamined Patent Application Publication No. 2006-183590 discloses a technique for forming a recess for receiving the connecting element press-fittingly in the driven rotary element and also forming a recess for receiving a bushing press-fittingly in the back side of the driven rotary element (see PTL 1). This balances the degrees of deformation in diameter in both the surfaces of the element and prevents the driven rotary element from deforming outward of the surface.

CITATION LIST

Patent Literature

PTL 1: Japanese Unexamined Patent Application Publication No. 2006-183590

SUMMARY OF INVENTION

However, in the technique disclosed in PTL 1, the degrees of deformation in diameter in both the surfaces of the driven rotary element are not necessarily canceled with each other due to, for example, a dimensional error in the bushing, connecting element, or recesses. As a result, the outward surface deformation may still be observed in the driven rotary element. This technique requires a step for press fitting the bushing in addition to the step for press fitting the connecting element. Therefore, not only the number of components is increased to lead to troublesome working, but also the outward surface deformation of the driven rotary element cannot be reliably prevented. Hence, the conventional technique noted above cannot be regarded as a rational art for providing the valve timing control device.

The object of the present invention is to provide a valve timing control device enabling simplification of the manufacturing process and reduction of the number of parts while suppressing deformation of the driven rotary element.

A first characteristic feature of the valve timing control device according to the present invention lies in comprising a driving rotary element synchronously rotatable with a crankshaft; a driven rotary element mounted coaxially with the driving rotary element and synchronously rotatable with a camshaft; a plurality of partitions provided in the driven rotary element each for dividing a fluid pressure chamber formed between the driving rotary element and the driven rotary element into a regarded angle chamber and an advanced angle chamber; and a connecting element having a press fitting portion that is press-fitted into a recess formed in the driven rotary element for connecting the driven rotary element to the camshaft, wherein the press fitting portion includes a plurality of fitting segments spaced apart from each other along a rotational direction to fit to an inner circumference of the recess, and at least one of centerlines of the fitting segments extending in a radial direction does not overlap any of the partitions.

In general, the driven rotary element includes a cylindrical portion formed adjacent a rotational center thereof and a plurality of partitions circumferentially provided at intervals in an outer circumference of the cylindrical portion. When the connecting element is press-fitted to such a driven rotary element in connecting the camshaft, the driven rotary element is inevitably deformed more or less as described above.

The present invention provides a technique for minimizing the influence of the deformation of the driven rotary element caused by the pressing of the connecting element. Providing any one of the fitting segments radially overlaps any one of the partitions, a contact portion of the driven rotary element coming into contact with the fitting segment is deformed radially outward. With such deformation, the partition associated with the contact portion is also enlarged in diameter. Here, the driven rotary element is deformed only at the side adjacent to the recess, and thus the partition moves to the opposite side to the recess and deforms. As the partition has a predetermined radial dimension, the deformation of the partition at an end thereof becomes great.

In order to eliminate such a disadvantage, according to the first characteristic feature of the present invention, at least one of the plurality of fitting segments formed in the connecting element is arranged so as not to radially overlap the corresponding partition of the driven rotary element. With such an arrangement, even if the cylindrical portion of the driven rotary element is deformed and enlarged in diameter, no partition is present radially outward of the deformed portion, and thus no outward deformation of the partition occurs. In this manner, it is possible to minimize the outward surface deformation of the driven rotary element by diminishing the number of the partitions radially corresponding to the fitting segment.

A second characteristic feature of the valve timing control device of the present invention lies in that all of the radially extending centerlines of the fitting segments are configured not to overlap any of the partitions.

With the above-noted arrangement in which all of the radially extending centerlines of the fitting segments are configured not to overlap any of the partitions, any of the partitions is not influenced by or is influenced a little by the deformation of the driven rotary element caused by the pressing of the fitting segments. More particularly, the deformation of the driven rotary element caused by the pressing of the fitting segments becomes a maximum on the centerlines of the fitting segments extending in the radial direction. Thus, the deformation of the driven rotary element as a whole can be a minimum by arranging the centerlines of the fitting segments so as not to overlap the partitions.

A third characteristic feature of the valve timing control device of the present invention lies in that all of the fitting segments are configured not to radially overlap any of the partitions other than the partition that is provided with at least one of a contact portion coming into contact with the driving rotary element for limiting relative movement between the driving rotary element and the driven rotary element and a lock mechanism for locking the driving rotary element and the driven rotary element in a predetermined rotational phase.

In general, at least one of the partitions of the driven rotary element is provided with the lock mechanism for locking the driving rotary element and the driven rotary element in the predetermined relative phase, or the contact portion coming into contact with the driving rotary element when the driven rotary element is rotated to the most advanced angle side or the most regarded angle side to limit further relative movement therebetween. When the lock mechanism is provided, the partition having the lock mechanism becomes larger than the remaining partitions in circumferential dimension because a lock pin should be provided. Similarly, when the contact portion is provided, the partition having the contact portion becomes larger than the remaining partitions in circumferential dimension because the contact portion should stand a shock of contact. As a result, the rigidity of the partition having the lock mechanism or the contact portion becomes greater than that of the remaining partitions. The partition that is provided with the lock mechanism or the like and having high rigidity is referred to as a high-rigidity partition, while the remaining partitions having low rigidity are referred to as low-rigidity partitions hereinafter.

In the arrangement having the third characteristic feature, none of the fitting segments agree with the low-rigidity partitions. If any of the fitting segments agrees with the high-rigidity partition or low-rigidity partition in the radial direction, the outward surface deformation caused by the radial agreement between the fitting segment and the low-rigidity partition is greater than the outward surface deformation caused by the radial agreement between the fitting segment and the high-rigidity partition. Thus, the outward surface deformation can be minimized by the arrangement in which none of the fitting segments corresponds to the low-rigidity partition.

A fourth characteristic feature of the present invention lies in that at least one of the plurality of fitting segments is configured to radially overlap the partition that is provided with at least one of the contact portion and the lock mechanism in the radial direction.

With the above-noted arrangement, the fitting segment agrees with the high-rigidity partition if it is unavoidable that any of the fitting segments radially agrees with any of the partitions. As a result, the outward surface deformation can be minimized even if somewhat deformation inevitably occurs, thereby to suppress overall deformation of the driven rotary element as much as possible.

A fifth characteristic feature of the present invention lies in that the connecting element has an axial support portion that supports in a through bore formed in the driving rotary element.

With the above-noted arrangement, the connecting element is allowed to have a function to axially support the driving rotary element. Thus, the connecting element axially supports the driving rotary element to reliably maintain the driving rotary element coaxially with the driven rotary element, while the construction can be simplified. As a result, the posture of the driven rotary element is stabilized.

A sixth characteristic feature of the present invention lies in providing a guide mechanism for guiding and positioning the driven rotary element and the connecting element in the predetermined rotational phase.

With the above-noted arrangement, the driven rotary element and the connecting element can be guided and positioned in the predetermined rotational phase through the guide mechanism, which facilitates the positioning of the driven rotary element and the connecting element.

DESCRIPTION OF EMBODIMENTS

[First Embodiment]

A valve timing control device according to an embodiment of the present invention that is applied to an automobile engine will be described hereinafter in reference to FIGS. 1 and 5.

[Overall Configuration]

Figure 1:
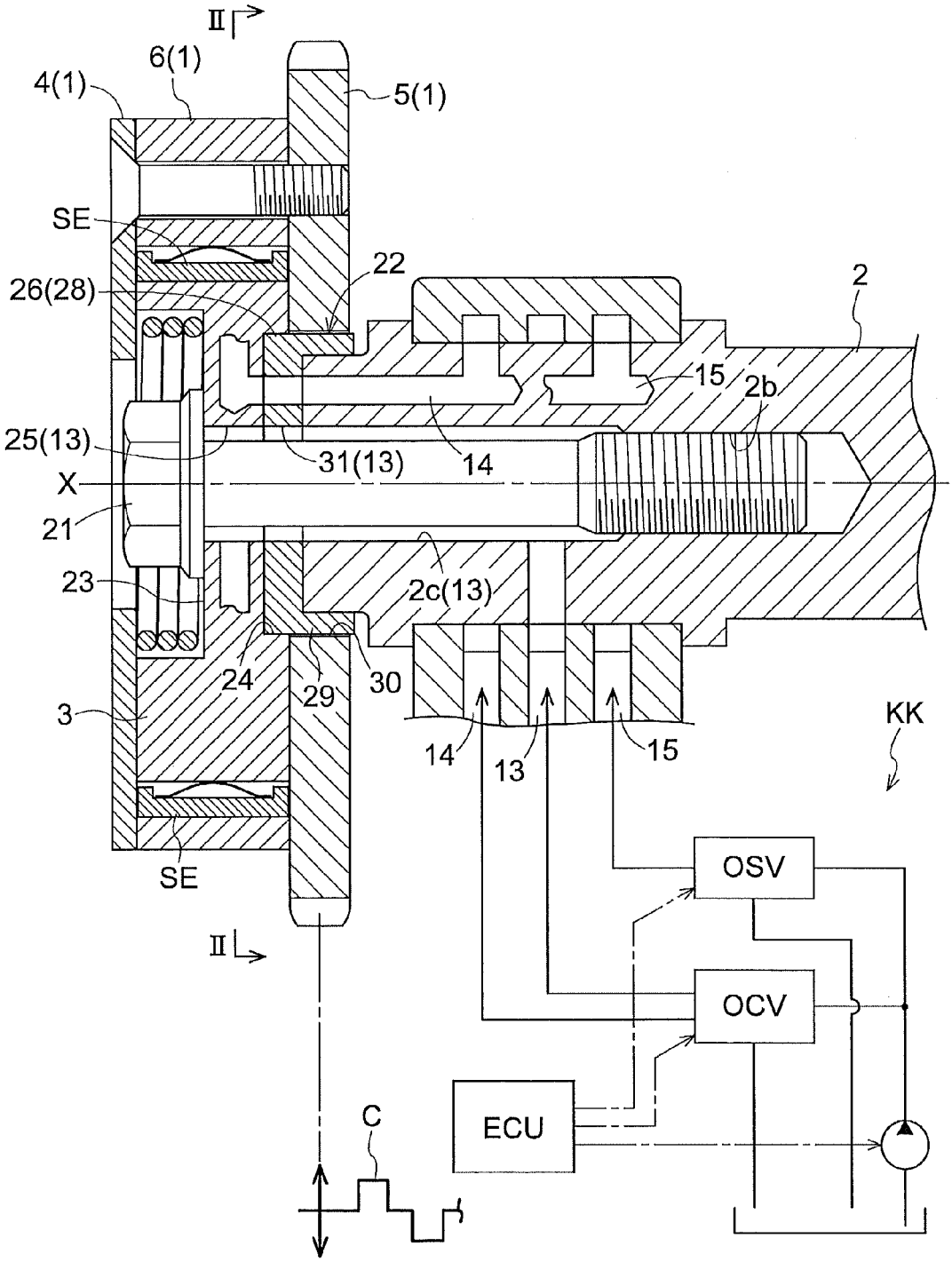
FIG. 1 is an overall view of a valve timing control device according to a first embodiment of the present invention.

Referring to FIG. 1, the valve timing control device is provided with a steel housing 1 (an example of a driving rotary element) that is synchronously rotatable with a crankshaft C of an engine, and an aluminum inner rotor 3 (an example of a driven rotary element) that is synchronously rotatable with a camshaft 2 of the engine. The housing 1 and the inner rotor 3 are coaxially arranged on an axis X.

[Housing and Rotor]

Referring to FIGS. 1 to 4, the housing 1 includes a front plate 4 mounted on a front side thereof opposite to the camshaft 2, a sprocket 5 mounted on a rear side thereof adjacent to the camshaft 2, and an outer rotor 6 mounted between the front plate 4 and the sprocket 5. The front plate 4, sprocket 5 and outer rotor 6 are fixedly screwed. Here, the housing 1 may be integrally formed as a unit instead of fixedly screwing the front plate 4, sprocket 5 and outer rotor 6 together. A rear plate may be mounted instead of the sprocket 5, and the sprocket may be provided at an outer circumference of the outer rotor 6.

Figure 2:
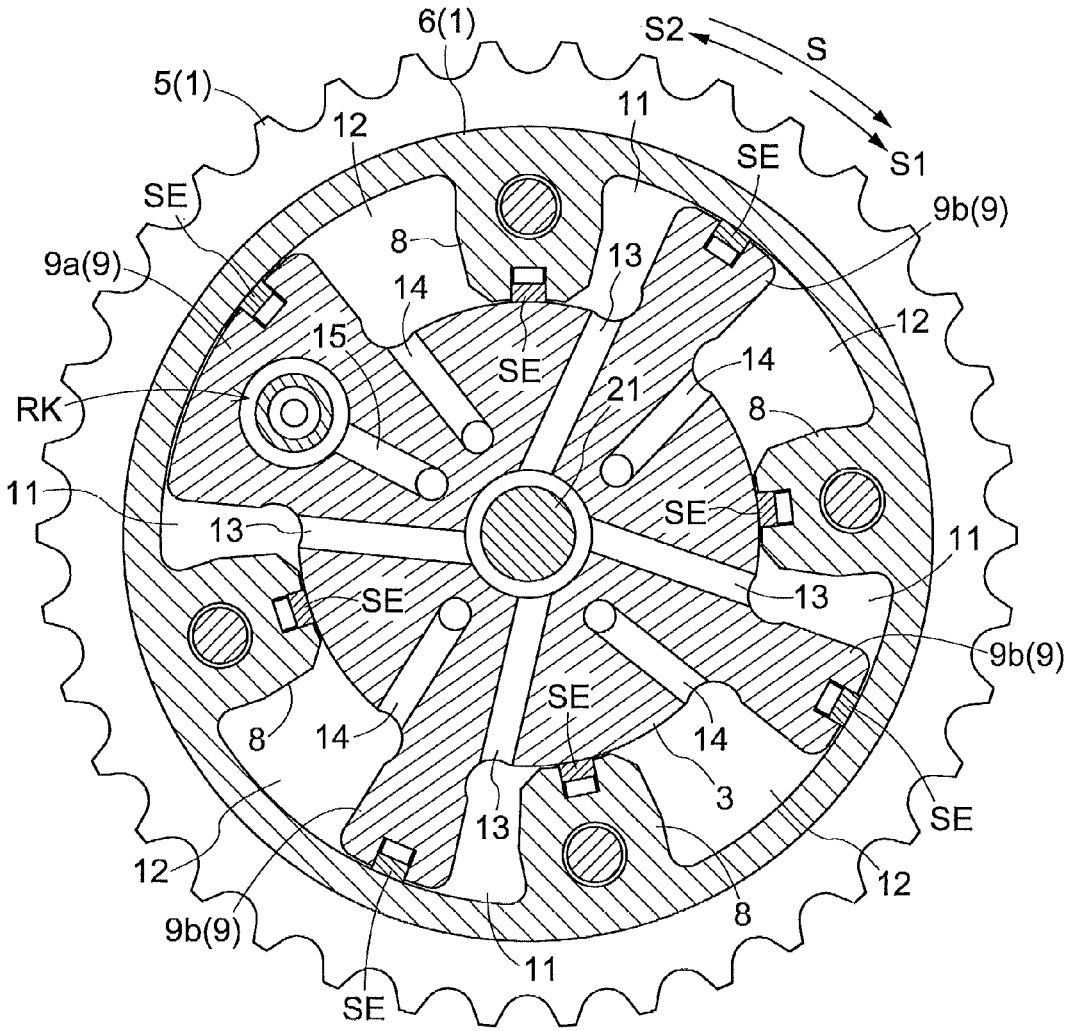
FIG. 2 is a cross-sectional view of the valve timing control device as viewed along arrows II-II of FIG. 1.

When the crankshaft C is rotated, a rotational driving force is transmitted to the sprocket 5 through a power transmission mechanism (not shown) to rotate the outer rotor 6 in a rotational direction S (see FIG. 2). As the outer rotor 6 is rotated, the inner rotor 3 is rotated in the rotational direction S to rotate the camshaft 2. Then, a cam (not shown) provided in the camshaft 2 pushes down on an intake valve (not shown) of the engine.

Figure 4:
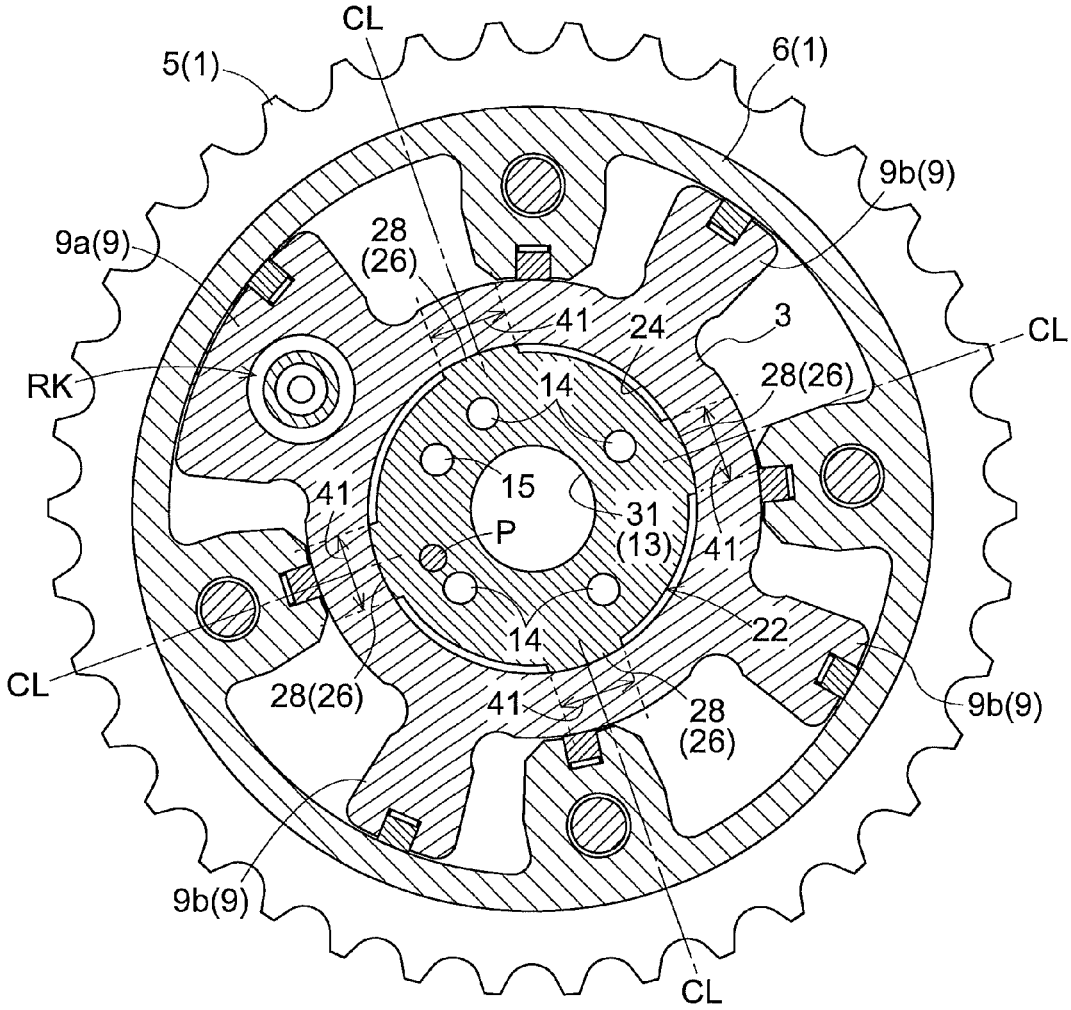
FIG. 4 is a cross-sectional view of the valve timing control device as viewed along arrows IV-IV of FIG. 3.

As shown in FIGS. 2 and 4, a plurality of first partitions 8 project inward in a radial direction from an inner circumference of the outer rotor 6. The first partitions 8 are spaced apart from each other along the rotational direction S. A plurality of second partitions 9 project outward in the radial direction from an outer circumference of the inner rotor 3. The second partitions 9 are also spaced apart from each other along the rotational direction S in the same manner as the first partitions 8. The first partitions 8 are configured to divide space between the outer rotor 6 and the inner rotor 3 into a plurality of fluid pressure chambers. The second partitions 9 are configured to divide each of the fluid pressure chambers into an advanced angle chamber 11 and a retarded angle chamber 12. In order to prevent leakage of engine oil between the advanced angle chamber 11 and the regarded angle chamber 12, sealing elements SE are provided in positions of the first partitions 8 opposed to the outer circumference of the inner rotor 3 and in positions of the second partitions 9 opposed to the inner circumference of the outer rotor 6, respectively.

Referring to FIGS. 1 and 2, within the inner rotor 3, a connecting element 22 and the camshaft 2 are formed an advanced angle passage 13 for connecting each advanced angle chamber 11 to a feed/discharge mechanism KK for allowing and intercepting feed or discharge of engine oil, a retarded angle passage 14 for connecting each regarded angle chamber 12 to the feed/discharge mechanism KK, and a lock passage 15 for connecting the feed/discharge mechanism KK to a lock mechanism RK for locking the inner rotor 3 and outer rotor 6 in a predetermined relative rotational phase.

The feed/discharge mechanism KK includes an oil pan, an oil motor, a fluid control valve OCV for allowing and intercepting feed or discharge of engine oil to/from the advanced angle passage 13 and the retarded angle passage 14, a fluid switch valve OSV for allowing and intercepting feed or discharge of engine oil to/from the lock passage 15, and an electric control unit ECU for controlling operation of the fluid control valve OCV and fluid switch valve OSV. As the feed/discharge mechanism KK is controlled, the relative rotational phase of the inner rotor 3 and outer rotor 6 is displaced in an advanced angle direction (arrow S1 in FIG. 2) or a regarded angle direction (arrow S2 in FIG. 2) or is maintained in a desired phase.

[Connecting Mechanism Between Inner Rotor And Camshaft]

Referring to FIGS. 1 to 5, the inner rotor 3, connecting element 22 and camshaft 2 are fastened through a bolt 21. The bolt 21 is fastened to a female screw 2*b* formed in the back of a receiving bore 2*c* formed in an extreme end of the camshaft 2. With such an arrangement, the inner rotor 3 is integrally assembled to the extreme end of the camshaft 2 through the connecting element 22.

More particularly, a first hollow 23 for accommodating the head of the bolt 21 is formed in a front surface of the inner rotor 3, while a second hollow 24 (an example of a recess) is formed in a rear surface of the inner rotor 3 for receiving press-fittingly a front part 26 (an example of a press-fitting portion) of the connecting element 22. A through bore 25 is formed between the first hollow 23 and the second hollow 24 for receiving the bolt 21.

Figure 5:
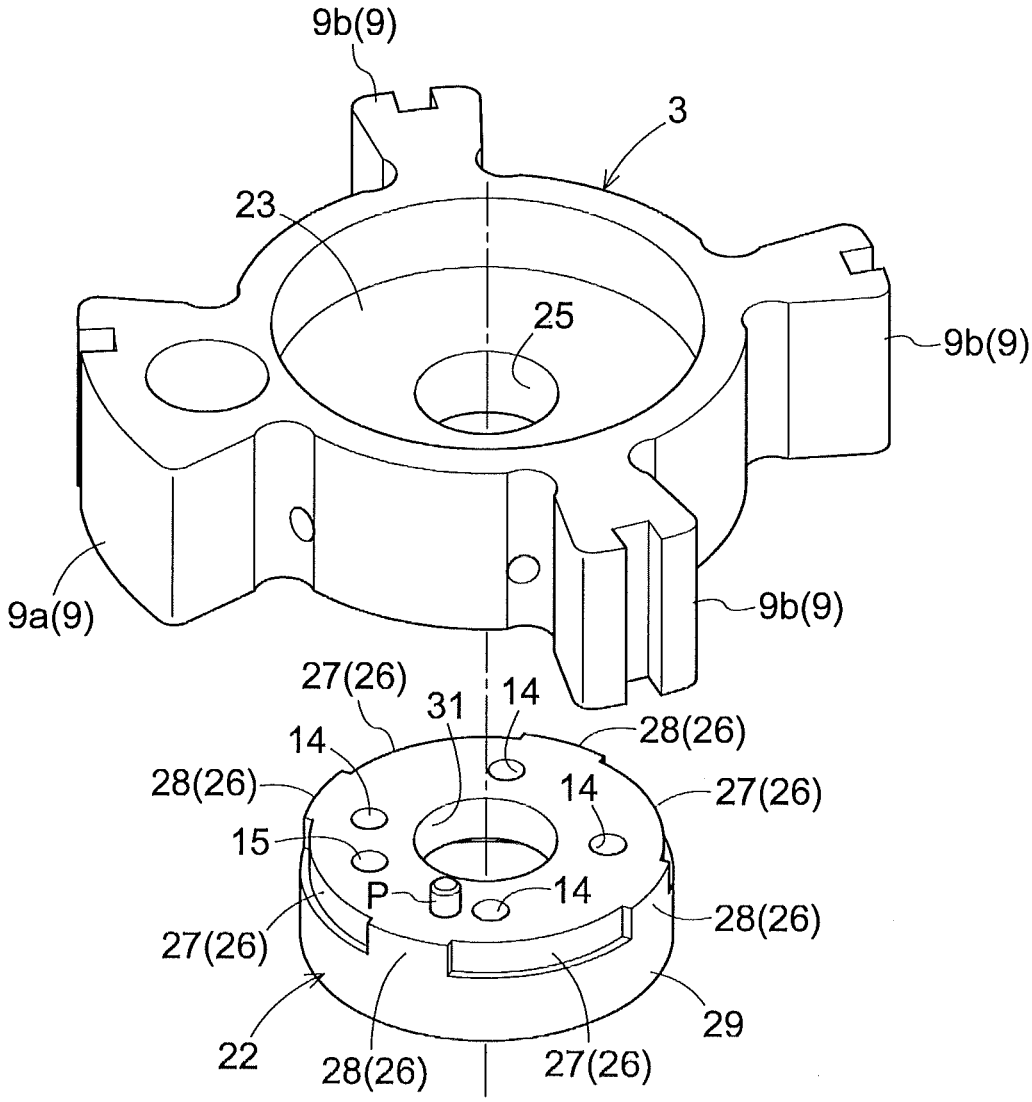
FIG. 5 is an exploded perspective view of the valve timing control device according to the first embodiment of the present invention.

As illustrated in FIG. 5, a plurality of cutaway segments 27 are spaced apart from each other along the rotational direction S in the front part 26 of the connecting element 22. Each section defined between the adjacent cutaway segments 27 acts as a fitting segment 28 that is press-fitted into an inner circumference of the second hollow 24. A plurality of the fitting segments 28 are arranged along a circumferential direction of the connecting element 22 at intervals of 90 degrees, for example. A width of each fitting segment 28 in an axial direction is substantially the same as or greater than a depth of the second hollow 24. A rear part 29 (an example of an axial support portion) of the connecting element 22 is supported in a round bore 30 of the sprocket 5. This enables the connecting element 22 to have a function to axially support the housing 1. Thus, the inner rotor 3 and the housing 1 are securely maintained in a coaxial relationship while the construction can be simplified, which stabilizes the posture of the inner rotor 3.

The connecting element 22 has an opening 31 formed in a front surface thereof for receiving the bolt 21, and a recess 32 formed in a rear surface thereof for receiving the extreme end of the camshaft 2. A front pin-receiving hole 3*a* is formed in the inner rotor 3, a rear pin-receiving hole 2*a* is formed in the extreme end of the camshaft 2, and an intermediate pin-receiving hole 22*a* is formed in the connecting element 22, respectively. A gap between the through bore 25 of the inner rotor 3 and the bolt 21, a gap between the opening 31 of the connecting element 22 and the bolt 21, and a gap between the receiving bore 2*c* of the camshaft 2 and the bolt 21 act together as the advanced angle passage 13.

Figure 3:
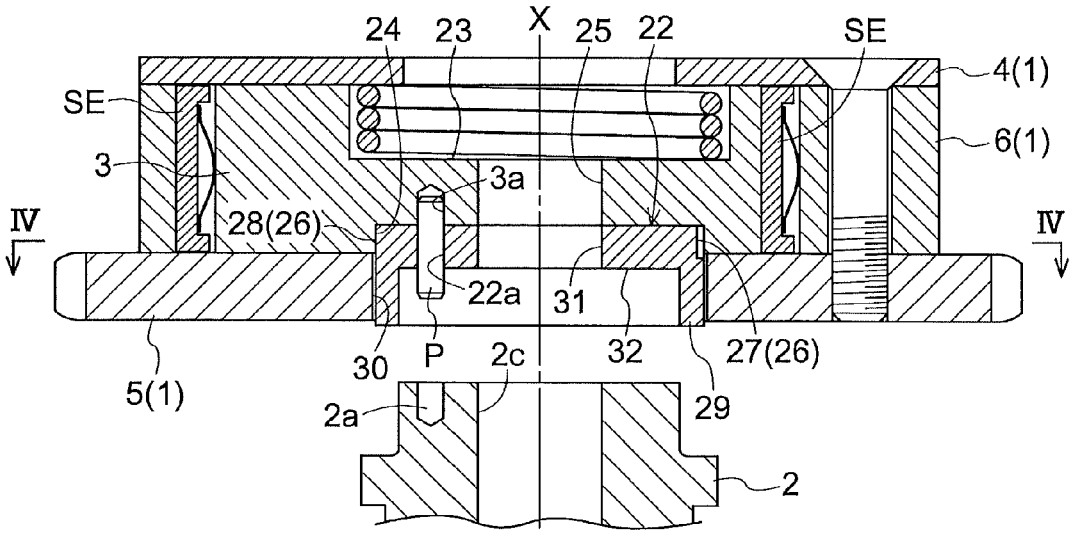
FIG. 3 is a cross-sectional view of a principal portion of the valve timing control device according to the first embodiment of the present invention.

As illustrated in FIG. 3, a pin P is inserted into the pin-receiving hole 3*a* of the inner rotor 3 and the pin-receiving hole 22*a* of the connecting element 22 to press fit the front part 26 of the connecting element 22 to the second hollow 24 of the inner rotor 3. Then, the pin P advances into the pin-receiving hole 2*a* formed in the extreme end of the camshaft 2 to insert the extreme end of the camshaft 2 to the recess 32 of the connecting element 22. As a result, the inner rotor 3, the connecting element 22 and the extreme end of the camshaft 2 are positioned in the predetermined relative rotational phase, thereby to form the advanced angle passage 13, the retarded angle passage 14 and the lock passage 15.

More particularly, the pin P and pin-receiving holes 3*a* and 22*a* act as a guide mechanism together for allowing the inner rotor 3 and the connecting element 22 to be positioned in the predetermined relative rotational phase. The inner rotor 3 and the connecting element 22 are guided and positioned in the predetermined rotational phase through the guide mechanism (pin P and pin-receiving holes 3*a* and 22*a*). This facilitates the positioning of the inner rotor 3 and the connecting element 22.

[Positional Relationship Between Fitting Segment and Second Partition]

As shown in the arrangement shown in FIG. 4, none of the fitting segments 28 may overlap any of the second partitions 9, for example. When the connecting element 22 is press-fitted into the second hollow 24, the portions of the inner rotor 3 corresponding to the fitting segments are somewhat deformed to be radially enlarged, but are not associated with any of the second partitions 9. Thus, none of the second partitions 9 are deformed in corners. As a result, the outward surface deformation of the whole inner rotor 3 can be minimized. In addition, fitted segments 41 in the inner rotor 3 are all deformed to the same extent, which can prevent eccentricity of the inner rotor 3.

While FIG. 4 shows the configuration in which none of the fitting segments 28 overlap the second partitions 9, it is sufficient that at least one of the fitting segments 28 does not overlap the corresponding second partition 9. This is because the deformation of the inner rotor 3 can be a minimum since the portion where the fitting segment 28 does not overlap the corresponding second partition 9 has no influence on the change of the posture of the second partition 9.

In the present invention, it is not that all of the fitting segments 28 should never radially overlap the corresponding second partitions 9. More particularly, the second partitions 9 may be arranged so as not to overlap centerlines CL of the respective fitting segments 28 extending in the radial direction. In such an arrangement, the deformation of the inner rotor 3 caused by the pressing of the fitting segments 28 becomes a maximum on the centerlines CL of the fitting segments 28 extending in the radial direction. Thus, the outward surface deformation of the whole inner rotor 3 can be minimized by arranging the second partitions 9 so as not to overlap the centerlines of the fitting segments 28. In the construction of the present invention in which the centerlines CL of all the fitting segments 28 extending in the radial direction are arranged so as not to overlap the corresponding second partitions 9 in the radial direction, any of the second partitions 9 is not influenced by or is influenced a little by the deformation of the inner rotor 3 caused by the pressing of the fitting segments 28.

[Second Embodiment]

Figure 6:
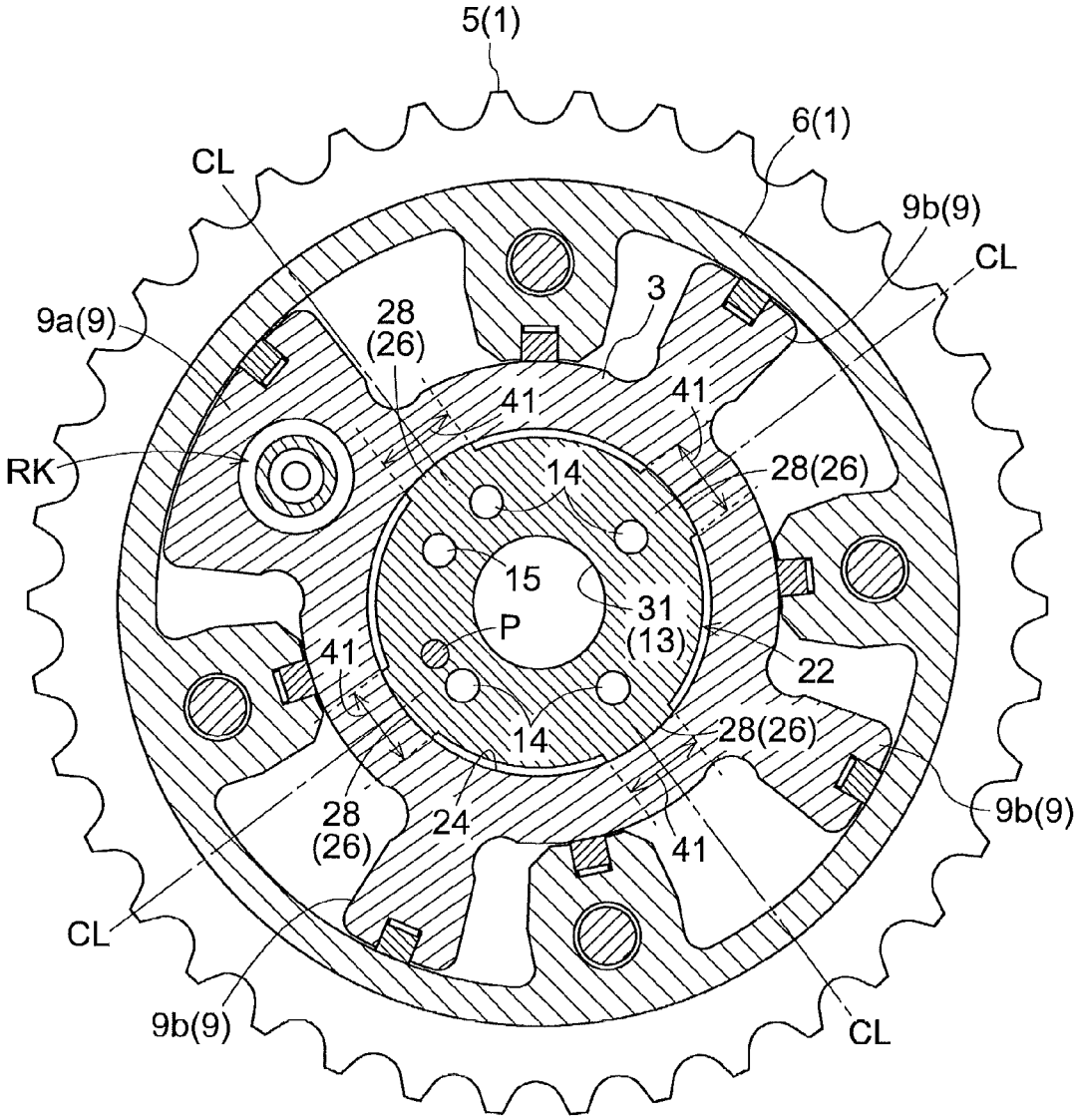
FIG. 6 is a cross-sectional view of the valve timing control device according to a second embodiment of the present invention.

Referring to FIG. 6, part of the fitting segments 28 overlaps the second partition 9 that is provided with the lock mechanism RK of the plurality of second partitions 9 in the radial direction, and the remaining fitting segments 28 do not overlap the second partitions 9 that are not provided with the lock mechanism RK. The second partition 9 that is provided with the lock mechanism RK is greater than the remaining second partitions in circumferential dimension and rigidity because the lock pin should be provided. Thus, the second partition that is provided with the lock mechanism RK is referred to as a high-rigidity partition 9*a*, while the remaining second partitions are referred to as low-rigidity partitions 9*b* hereinafter.

In the embodiment shown in FIG. 6, while three fitting segments 28 can be arranged so as not to overlap any of the second partitions 9, one fitting segment 28 inevitably overlaps any one of the second partitions 9. In such a case, the high-rigidity partition 9*a* is selected as the second partition 9 to overlap. More particularly, the high-rigidity partition 9*a* is not much subject to the influence of the pressing of the connecting element 22 because of its high rigidity. Therefore, the outward surface deformation in the corresponding fitted segment 41 is diminished, which results in the minimal overall deformation of the inner rotor 3. The fitted segments 41 fitted to the remaining three fitting segments 28 are formed in cylindrical portions of the inner rotor 3. Thus, while the cylindrical portions are deformed by the pressing of the fitting segments 28, such deformation has no influence on any of the low-rigidity partitions 9*b*.

In the second embodiment, only one fitting segment 28 radially overlaps the high-rigidity partition 9*a* that is provided with the lock mechanism RK. Instead, a plurality of the fitting segments 28 may overlap one high-rigidity partition 9*a*. Alternatively, a plurality of the high-rigidity partitions 9*a* may correspond to the plurality of fitting segments 28, respectively. In any case, the above-described effect of suppressing the deformation of the inner rotor 3 can be achieved.

[Modified Embodiment]

Figure 7:
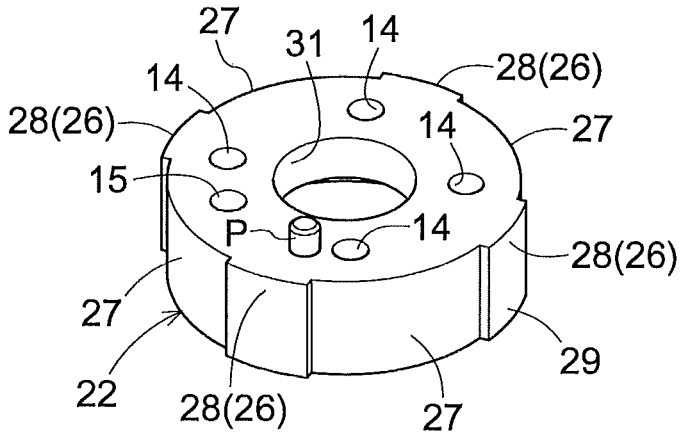
FIG. 7 is a perspective view of a connecting element according to a modified embodiment.
Figure 8:
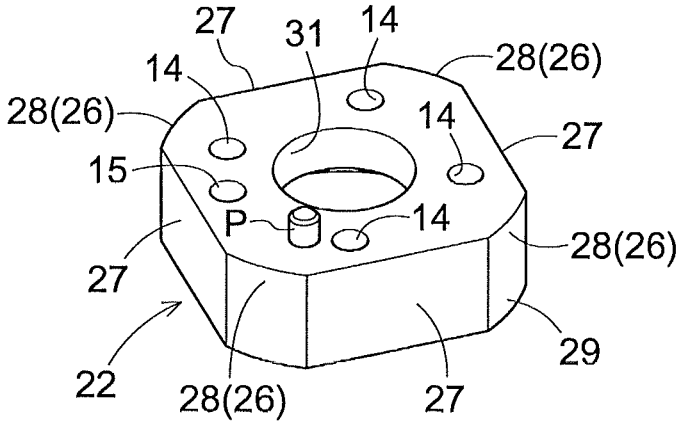
FIG. 8 is a perspective view of a connecting element according to another modified embodiment.

Each fitting segment 28 of the connecting element 22 may be shaped as shown in FIGS. 7 and 8. More particularly, the fitting segment 28 may be formed in a region extending from the front side to the back side of the connecting element 22 as shown in FIG. 7.

Alternatively, as shown in FIG. 8, the connecting element 22 may have a combination of cutaway parts 27 each having a flat surface and fitting segments 28 each having a cylindrical surface. The fitting segments 28 may be formed by chamfering four corners of a square material. Alternatively, the cutaway parts 27 may be formed by cutting four sections away from a disk material to flat surfaces.

Any of the above-described arrangements can provide the connecting element 22 that can minimize the deformation of the inner rotor 3. The connecting element 22 shown in FIG. 8, in particular, is easy to process in shape, and thus can be manufactured cost-effectively.

The present invention is applicable to a valve timing control device for an internal combustion engine of an automobile, for example.

The invention claimed is:

1. A valve timing control device comprising:

a driving rotary element synchronously rotatable with a crankshaft;

a driven rotary element mounted coaxially with the driving rotary element and synchronously rotatable with a camshaft;

a plurality of partitions provided in the driven rotary element each for dividing a fluid pressure chamber formed between the driving rotary element and the driven rotary element into a retarded angle chamber and an advanced angle chamber;

a connecting element having a press fitting portion that is press-fitted into a recess formed in the driven rotary element for connecting the driven rotary element to the camshaft, the recess having a stepless inner periphery, wherein the press fitting portion includes a plurality of fitting segments spaced apart from each other along a rotational direction to fit to an inner circumference of the recess, the plurality of fitting segments contact the inner periphery while a plurality of cutaway segments each formed between the adjacent fitting segments are spaced from the inner periphery, and at least one of centerlines of the fitting segments extending in a radial direction does not overlap any of the partitions.

2. The valve timing control device as defined in claim 1, wherein all of the radially extending centerlines of the fitting segments are configured not to overlap any of the partitions.

3. The valve timing control device as defined in claim 1, wherein all of the fitting segments are configured not to radially overlap any of the partitions other than the partition that is provided with at least one of a contact portion coming into contact with the driving rotary element for limiting relative movement between the driving rotary element and the driven rotary element and a lock mechanism for locking the driving rotary element and the driven rotary element in a predetermined rotational phase.

4. The valve timing control device as defined in claim 3, wherein at least one of the plurality of fitting segments is configured to radially overlap the partition that is provided with at least one of the contact portion and the lock mechanism in the radial direction.

5. The valve timing control device as defined in claim 1, wherein the connecting element has an axial support portion that is supported in a through bore formed in the driving rotary element.

6. The valve timing control device as defined in claim 1, further comprising a guide mechanism for guiding and positioning the driven rotary element and the connecting element in the predetermined rotational phase.

7. The valve timing control device as defined in claim 1, further comprising:

a retard angle passage connected to the retarded angle chamber which allows fluid to flow into and out of the retarded angle chamber;

an advance angle passage connected to the advanced angle chamber which allows fluid to flow into and out of the advanced angle chamber; and wherein the cutaway segment is formed between the adjacent fitting segments, the cutaway segment is spaced from the inner periphery of the recess of the driven rotary element, and the cutaway segment is provided at a portion which is different from the retard angle passage and the advanced angle passage.

* * * * *